United States Patent [19]

Ohkaji et al.

[11] Patent Number: 4,984,024

[45] Date of Patent: Jan. 8, 1991

[54] IMAGE TRANSFER UNIT FOR IMAGE RECORDING APPARATUS

[75] Inventors: Hiroyuki Ohkaji; Itaru Matsuda, both of Yokohama; Masato Yanagida, Tokyo, all of Japan

[73] Assignee: Ricoh Company, Ltd., Tokyo, Japan

[21] Appl. No.: 350,695

[22] Filed: May 9, 1989

[30] Foreign Application Priority Data

| | | | |
|---|---|---|---|
| May 11, 1988 | [JP] | Japan | 63-61100[U] |
| Jul. 4, 1988 | [JP] | Japan | 63-87962[U] |
| Dec. 8, 1988 | [JP] | Japan | 63-158982[U] |
| Mar. 15, 1989 | [JP] | Japan | 61-60612 |

[51] Int. Cl.[5] ..... G03G 15/14; G03G 15/01

[52] U.S. Cl. ..... 355/273; 355/274; 355/326

[58] Field of Search ..... 355/271, 273-275, 355/326-327

[56] References Cited

U.S. PATENT DOCUMENTS 3,838,919 10/1974 Takahashi ..... 355/271 X

FOREIGN PATENT DOCUMENTS

| | | | |
|---|---|---|---|
| 55-38525 | 3/1980 | Japan | 355/274 |
| 55-33072 | 8/1980 | Japan . | |
| 56-97357 | 8/1981 | Japan . | |
| 58-100860 | 6/1983 | Japan | 355/326 |
| 61-232478 | 10/1986 | Japan | 355/326 |

*Primary Examiner*—Joan H. Pendegrass

*Attorney, Agent, or Firm*—Oblon, Spivak, McClelland, Maier & Neustadt

[57] ABSTRACT

An image transfer unit for an image recording apparatus which comprises a plurality of photoconductor units on which a toner image is formed, a dielectric transfer belt which circulates along and in contact with the plurality of photoconductor units, a record paper conveyed by the transfer belt, at least one transfer charger for transferring the toner image from each of the photoconductor units to the record paper in such a way that a plurality of toner images are superposed on each other one by one. The electric conductive member is disposed behind and in the vicinity of the transfer belt.

12 Claims, 6 Drawing Sheets

IMAGE TRANSFER UNIT FOR IMAGE RECORDING APPARATUS

BACKGROUND OF THE INVENTION

The present invention relates to an image recording apparatus. More particularly, the present invention relates to an image transfer unit which comprises a transfer belt disposed along a plurality of photoconductors and transfers toner images from each of the photoconductors to the transfer belt or a paper placed on and conveyed by the belt.

An electrophotographic multi-color image recording apparatus comprises an image transfer unit which generally utilizes a technique in which toner images of different colors separated from an original color are superposed one above the other to form a multi-color image corresponding to the original. A conventional image transfer unit comprises for example four photoconductor drums on which color data of an image to be recorded with respect to yellow, magenta, cyan and black are written to form a latent image of a respective different color thereon and developing devices each arranged in connection with each of the four photoconductor drums, respectively. The original color is separated to three colors, i.e., blue, green and red each of which is detected by a respective optical sensor. An image processor calculates color data of yellow, magenta, cyanogen and black on the basis of the luminous intensity of each of the separated three colors. The electrostatic latent images formed on the photoconductor drums are developed by a toner of a corresponding color contained in the respentive corresponding developing device. A record paper is fed onto a transfer belt from a paper container through a resist roller and conveyed by the transfer belt which circulates along the photoconductor drums and comes in contact therewith one after another. The record paper is electrostatically sticked and secured to the conveyor belt surface. The visible toner images formed on the photoconductor drums are transferred to the record paper by a function of a transfer charger disposed behind the transfer belt at the position of each photoconductor drum in such a manner that the different color toner images are superposed one above the other to form an image of multicolors on the record paper. After that, the multi-color image is fixed on the paper by a fixing roller.

Such a transfer unit comprising the transfer belt which is generally made from a dielectric material requires a back up means for supporting the transfer belt from behind thereof so that the belt or the paper carried by the belt reliably comes in contact with the photoconductor surface. Such a back up means generally comprises rollers which are disposed behind and along the transfer belt and driven to rotate at the same speed as the transfer belt or move along with the belt so as to decrease the load upon the transfer belt. Such kind of back up rollers are usually made from a metal so that the rollers are easily processed to accurately form a cylindrical shape and grounded to the earth.

The transfer belts are electrostatically charged by the transfer charger at the time of the transferring operation. Since the metallic back up rollers are in contact with the transfer belt, the image to be transferred from the photoconductor to the transfer belt or the paper placed on the belt is apt to be disturbed and deformed, as described in Japanese Examined Patent Publication Nos. 55-33072 and 56-97357. The reason for this is that when the transfer belt suddenly comes in contact with the back up roller, a disturbance electric field is generated between the belt and the back up roller so that the transferring electric field applied to the toner is disturbed whereby the toner is scattered especially in the horizontal direction. Such a disturbance electric field is also generated at the time when the belt is moved away from the back up roller. Also, according as the transfer belt moves away from the back up roller, the electric voltage between the transfer belt and the back up roller rises which causes to generate a separation discharge therebetween so that the electric charge charged behind the transfer belt is eliminated which extinguishes the electrostatic force to hold the toner which therefore is scattered.

SUMMARY OF THE INVENTION

It is therefore an object of the present invention to provide an image transfer unit for an image recording apparatus which makes it possible to obviate the problem due to the provision of the back up rollers mentioned above so that the toner image is reliably transferred to the record paper without being disturbed.

The object of the invention can be achieved by an image transfer unit for an image recording apparatus comprising electric conductive members which are arranged along and behind the transfer belt between the positions of photoconductors.

An advantage of the above-mentioned arrangement of the present invention is that the electric field applied to the toner transferred to the record paper carried by the transfer belt is stabilized so that the toner image formed on the record paper is not disturbed, since an abrupt change of the electric field is avoided at the time when the transfer belt comes close to the position of the back up roller or moves away therefrom. Also, it becomes possible to suppress rising of the electric voltage between the transfer belt and the back up roller or between the transfer belt and the electric conductive member so that the generation of the adverse separation discharge is minimized, since the electric conductive members are arranged behind and close to the transfer belt.

Further objects and advantages of the present invention will be apparent from the following description of the preferred embodiments of the invention as illustrated in the accompanying drawings.

DESCRIPTION OF THE PREFERRED EMBODIMENTS

Figure 6:
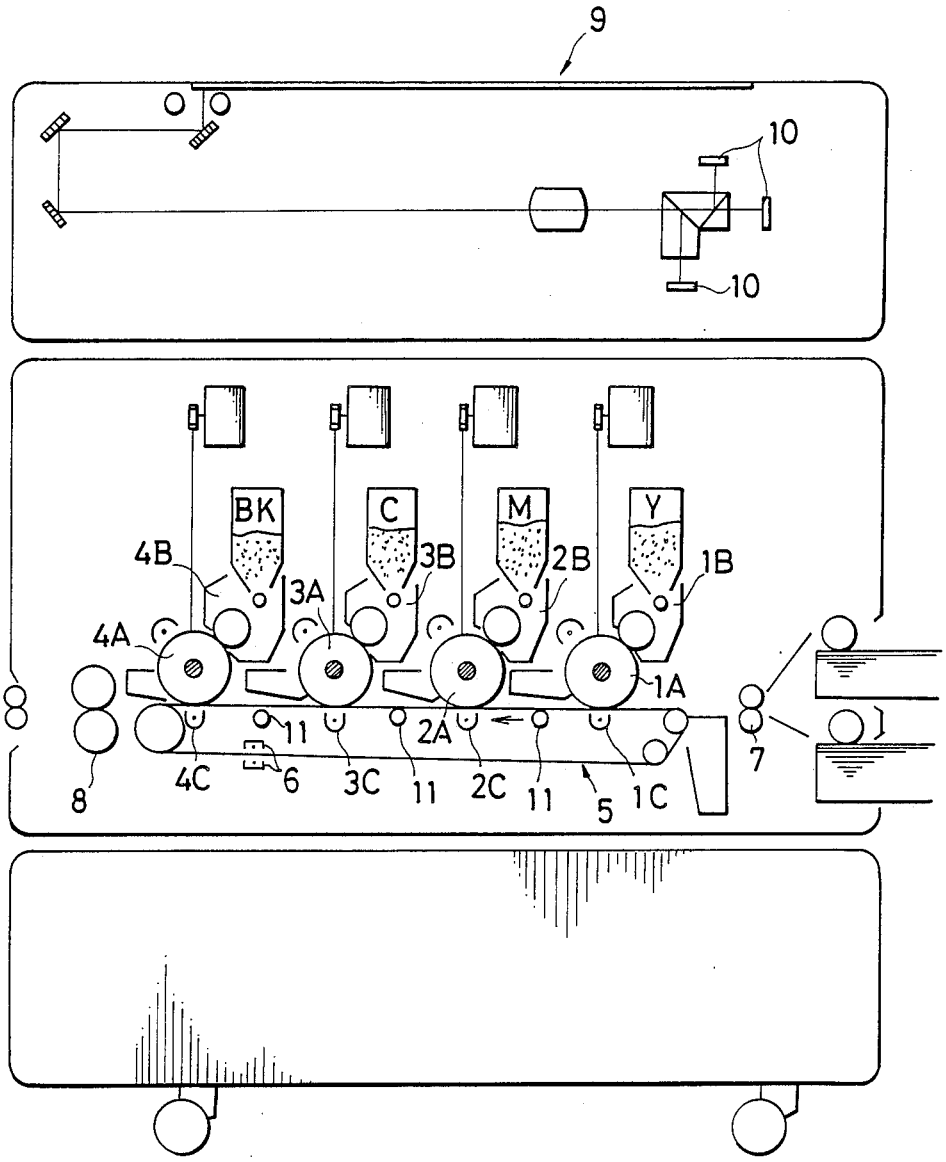
FIG. 6 is a constructional side view of an example of an image recording apparatus to which the present invention is applied.

FIG. 6 illustrates an example of an image recording apparatus to which the present invention is applied. An image transfer unit of this image recording apparatus comprises four photoconductor drums 1A, 2A, 3A and 4A on which color data of an image to be recorded with respect to yellow, magenta, cyanogen and black are optically written to form a latent image of a respective different color thereon and developing devices 1B, 2B, 3B and 4B each arranged in connection with each of the four photoconductor drums, respectively. The original color is separated to three colors, i.e., blue, green and red each of which is detected by a respective optical sensor. An image processor calculates color data of yellow, magenta, cyanogen and black on the basis of the luminous intensity of each of the separated three colors. The electrostatic latent images formed on each of the photoconductor drums 1A, 2A, 3A and 4A are developed by a toner of a corresponding color contained in the respentive corresponding developing device. A record paper is fed onto a transfer belt 5 from a paper container through a resist roller unit 7 and conveyed by the transfer belt 5 which circulates along the photoconductor drums and comes in contact therewith one after another. The record paper is electrostatically sticked and secured to the conveyor belt surface. The visible toner image formed on each of the photoconductor drums 1A, 2A, 3A and 4A are transferred to the record paper by a function of a corresponding transfer charger 1C, 2C, 3C or 4C disposed behind the transfer belt 5 at the position of each photoconductor drum in such a manner that the different color toner images are superposed one above the other to form an image of multicolors on the record paper. After that, the multi-color image is fixed on the paper by a fixing roller unit 8.

The multi-color recording apparatus illustrated in FIG. 6 comprises an image reading unit 9 disposed on the apparatus body. The color of an original (not shown) to be copied is optically separated to the above mentioned three colors and read by three CCDs 10, respectively, arranged in the image reading unit 9. An image processor device (not shown) calculates image color data for each color on the basis of the output signal from each of the three CCDs 10. A laser beam source is disposed for each of the photoconductor drums 1A, 2A, 3A and 4A. Each laser beam source is driven to turn on and off in accordance with the calculated image color data to optically write the image of each separated color on the photoconductor drum.

The transfer belt 5 is made from a dielectric material such as a polyester film. The transfer belt 5 is electrostatically charged by the transfer charger 1C, 2C, 3C and 4C, respectively, at the time of the transferring operation. Therefore, it is necessary to eliminate the electrostatic charge on the transfer belt and set the belt in an initial state before the subsequent transferring operation is started. For this purpose, electrostatic elimination chargers 6 are disposed on either side of the transfer belt 5. Each of the transfer chargers 1C, 2C, 3C and 4C comprises a corona discharge wire arranged in a shield plate disposed along the width of the photoconductor drum.

Figure 1:
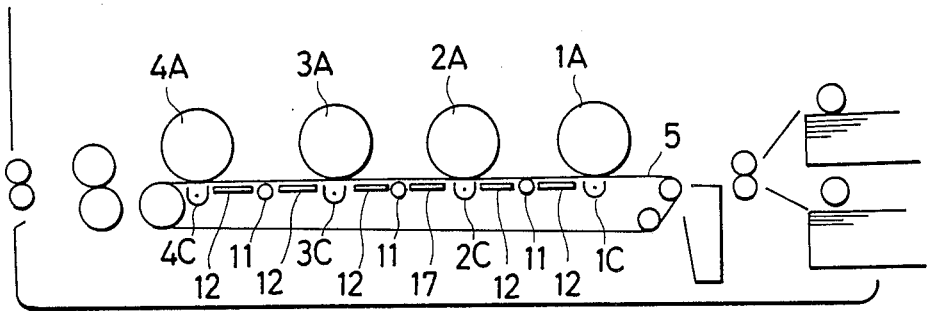
FIG. 1 is a constructional side view of an embodiment of the present invention.

FIG. 1 illustrates an image transfer unit in accordance with the present invention which is applied to the image recording apparatus of FIG. 6. In accordance with this embodiment of the invention, the transfer unit comprises electric field stabilizing plates 12 which are made from a metal and disposed evenly behind the upper passage of the transfer belt 5 and between each of the transfer chargers and each of the back up rollers 11, coming in contact with the rear surface of the transfer belt.

By the provision of the stabilizing plates 12, it becomes possible to stabilize the electric field applied to the toner transferred to the record paper carried by the transfer belt so that the toner image formed on the record paper is not disturbed, since an abrupt change of the electric field is avoided at the time when the transfer belt comes close to the position of the back up roller 11 or moves away therefrom. Also, it becomes possible to suppress rising of the electric voltage between the transfer belt 5 and the back up roller 11 or between the transfer belt 5 and the stabilizing plates 12 so that the generation of the adverse separation discharge is minimized, since the stabilizing plates 12 are arranged behind and close to the transfer belt 5.

The electric field stabilizing plates 12 are grounded directly to the earth or through a resistance or a voltage stabilizer and maintained at a constant voltage. Such stabilizing plates 12 may be made from any electric conductive material such as conductive resin instead of metal mentioned above.

Figure 2:
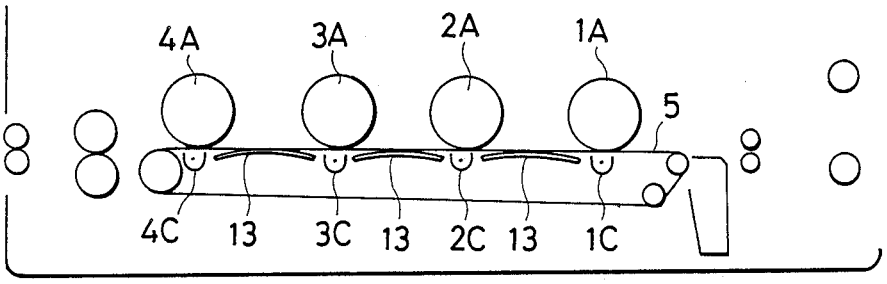
FIG. 2 is a constructional side view of another embodiment of the present invention.

FIG. 2 illustrates another embodiment of the present invention. According to this embodiment, the back up rollers are deleted. Instead, electric field stabilizing plates 13 having a circular arc section are disposed behind the transfer belt 5 and in contact therewith to back up the transfer belt.

It is to be noted that the stabilizing plates 13 may be disposed outer the transfer belt 5, i.e., in the upper side of the upper passage of the transfer belt 5. However, in this case, the stabilizing plates must be carefully arranged not to be too close to the belt surface so as not to come in contact with the record paper conveyed by the transfer belt.

It is revealed by experiments by the inventors that the effect of prevention against disturbance of the toner image due to the arrangement of electric field stabilizing plates is related to the relative position between the edge of the shield plate of the transfer charger, the edge of the electric stabilizing plate at the transfer charger side and the transfer belt.

This is explained hereinafter in detail with reference to FIG. 3.

Figure 3:
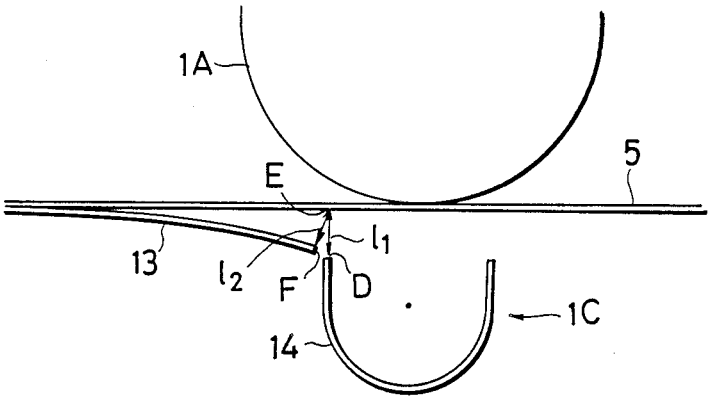
FIG. 3 is an explanatory view showing a part of the structure of the present invention for explaining the function thereof.
Figure 5:
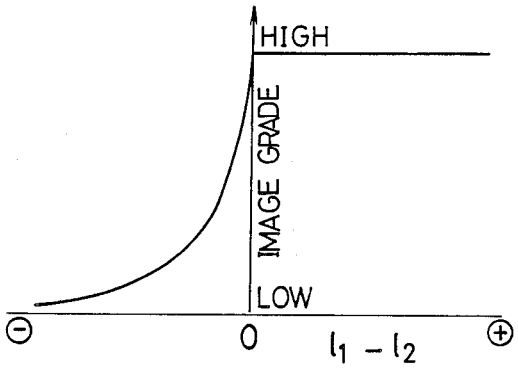
FIG. 5 is a graphical view for showing effect of the present invention.

FIG. 3 illustrates a portion around the transfer charger 1C of the image transfer unit of FIG. 2 in an enlarged scale. In the drawing, D designates an edge of the shield plate 14 of the transfer charger 1C and E designates an intersection between the rear surface of the transfer belt 5 and a normal line from the point D with respect to the transfer belt 5. The distance between the points D and E is represented by $l_1$. Also, F designates an edge of the electric field stabilizing plate 13 at the transfer charger side. The distance between the points E and F is represented by $l_2$. A toner image is formed on the photoconductor drum 1A as mentioned above. A record paper (not shown) is conveyed by the transfer belt 5 from the right to the left in the drawing. The toner image formed on the photoconductor drum 1A is transferred to the record paper by the function of the transfer charger 1C. In this transferring operation, the electrostatic force to hold the toner transferred to the record paper depends on the distance to the electrode. Therefore, if the value $(l_1-l_2)$ is less than zero, the electric field applied to the toner suddenly changes at the points D and F, which causes to disturb the toner image. FIG. 5 is a graphical view of grade of the toner image in relation to the value $(l_1-l_2)$. The ordinate represents the toner image grade in which high grade image without disturbance is represented in the upper portion whereas low grade image being disturbed is represented in the lower portion of the graph. The abscissa represents the value $(l_1-l_2)$.

The shield plate 14 of the transfer charger 1C and the electric field stabilizing plate 13 are arranged in such a way that the condition $l_1-l_2 \geqq 0$, i.e., $l_1 \geqq l_2$, is satisfied. By such an arrangement, it becomes possible to obviate the sudden change of the electric field during passing through the shield plate 14 of the transfer charger 1C and the electric field stabilizing plate 13 after the toner image is transferred to the record paper. Therefore, a high grade toner image can be obtained.

Figure 4:
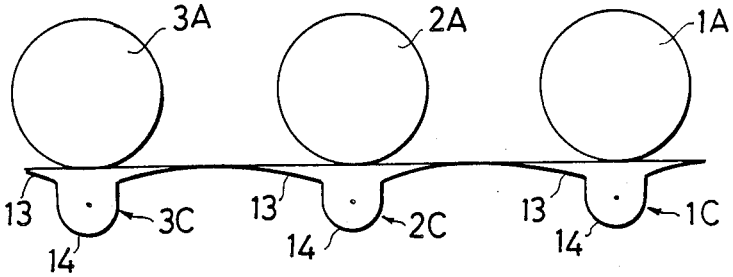
FIG. 4 is a constructional side view of a further embodiment of the present invention.

FIG. 4 illustrated a further embodiment of the present invention. In this embodiment, the shield plate 14 of each of the transfer chargers 1C, 2C and 3C and the electric field stabilizing plate 13 are connected together at the end thereof to form a continuous structure of conductive material so that $l_1$ becomes equal to $l_2$, thus realizing a most desirable structure which comprises a continuous electrode.

The embodiments mentioned above comprises a plurality of photoconductor drums with which an endless transfer belt comes in contact so that the toner image formed on each of the photoconductors is transferred to a record paper carried on the transfer belt. However, the present invention can be applied to an image recording apparatus which comprises one single photoconductor drum on which a plurality of different color images are formed which toner images are transferred to the record paper being superposed one above the other in sequence one after other to form a multi-color image in the same manner as the embodiments mentioned above.

In the embodiment illustrated in FIG. 1, the transfer unit is constructed in such a manner that the back up rollers 11 are arranged in contact with the lower side of the transfer belt 5 and that the electric field stabilizing plates 12 are arranged separated from but close to the lower surface of the transfer belt 5. Also, in the embodiment illustrated in FIG. 2, the electric field stabilizing plates 13 are arranged partly in contact with the transfer belt 5.

In the structure of FIG. 1, a gap is provided between the transfer belt and the electric field stabilizing plate 12. However, this gap is very small so that it is recognized from an experimental result that the electric field and the toner image are not disturbed due to the gap.

Also, in the embodiment of FIG. 2, the electric field stabilizing plate comes in contact with the transfer belt so as to back up the belt. However, this frictional resistance force is very small so that the conveying force of the transfer belt is not weakened since the contact area between the electric field stabilizing plate and the transfer belt is small.

As mentioned above, in accordance with the present invention, it becomes possible to stabilize the electric field so that a high grade and clear toner image can be obtained.

Further embodiments are described hereinafter with reference to FIGS. 7 to 13. The embodiments of the transfer unit of the image recording apparatus of the present invention described below are constructed so that the disturbance of the toner image is further reliably obviated.

These embodiments comprise, in addition to the electric field stabilizing plates disposed behind and in the vicinity of the transfer belt, a plurality of electric conductive members disposed between the photoconductor drums and in the paper placing upper side of the transfer belt spacing a predetermined gap provided between the electric conductive member and the transfer belt surface.

With the transfer unit structure mentioned above in which electric conductive members are arranged between the photoconductor drums and in the upper side of the transfer belt in addition to the electric stabilizing plated disposed behind the transfer belt, it becomes possible to minimize the horizontal force which acts on the toner even when the discharge voltage or the electric field between the transfer belt and the stabilizing plate is disturbed. This is because a vertical electric field is generated between the toner and the electric conductive members due to these electric conductive members disposed above the transfer belt and facing to the record paper carried thereon. Thus, the electric field is stabilized either by the stabilizing plates of conductive material disposed in the upper side of the transfer belt or the electric conductive members disposed in the lower side of the transfer belt, which makes it possible to reliably obviate the disturbance of the toner image.

A cleaning unit for removing toner remaining on the photoconductor drum surface can be utilized as the electric conductive member mentioned above instead of newly preparing an individual member.

Another problem of the full color copying apparatus is that maltransfer of toner occurs in the copying process in which toner is missed in an edge of the transferred image especially in an image of a thin line or a shadow area where much toner is required. In order to obviate the problem of such a maltransfer of toner, a fluidity aiding agent such as hydrophobic silica is conventionally added.

However, such a hydrophobic silica added toner is not adequate to use in the above-mentioned transfer unit structure in which electric conductive members are disposed in the upper side of the transfer belt in addition to the electric conductive stabilizing plates disposed in the lower side of the transfer belt, since toner is scattered over the surface of the electric conductive members disposed above the transfer belt facing to the toner image to be transferred and attached thereto. Therefore, clearness of the toner image is degraded due to the scattered toner. Also, the toner attached on the electric conductive member is accumulated thereon so that the toner accumulated on the conductive member comes in contact with the record paper and rubs the transferred toner image formed on the record paper.

In order to obviate this problem, a still further embodiment of the present invention improves the structure of the above-mentioned embodiment and comprises a dielectric guide member which is arranged in contact with the transfer belt surface and guides the transfer belt to move in the lateral direction of the photoconductor drum spacing a predetermined gap between the transfer belt and the electric conductive member disposed behind the belt.

The reason why the toner scatters over the electric conductive member as mentioned before is supposed that on the condition that the Coulomb attraction force of the electrostatic charge on the record paper including the toner image is balanced to that of the electrostatic charge on the lower surface of the transfer belt, when the lower surface of the transfer belt which is charged at a high voltage comes in contact with or very close to a metallic member which is at a low voltage, the electrostatic charge on the lower surface of the transfer belt is eliminated in appearance so that toner is forced to move upward by the Coulomb force along an electric field generated in the upward direction.

The improved embodiment of the present invention mentioned above comprises a dielectric guide member which guides the transfer belt maintaining a predetermined distance between the transfer belt and the electric conductive member disposed behind the transfer belt. Therefore, the transfer belt is prevented from coming in contact with or very close to the electric conductive member disposed behind the transfer belt. For this reason as well as due to the dielectricity of the conductive member, the electrostatic charge on the lower surface of the transfer belt is prevented from being eliminated, which makes it possible to reliably carry the toner in a stable condition. Therefore, it becomes possible to avoid scattering of the toner thus obviating the problems of degradation of clearness of toner image and rubbing of the toner image.

The above-mentioned embodiments are further described in detail below with reference to the drawings.

Figure 7:
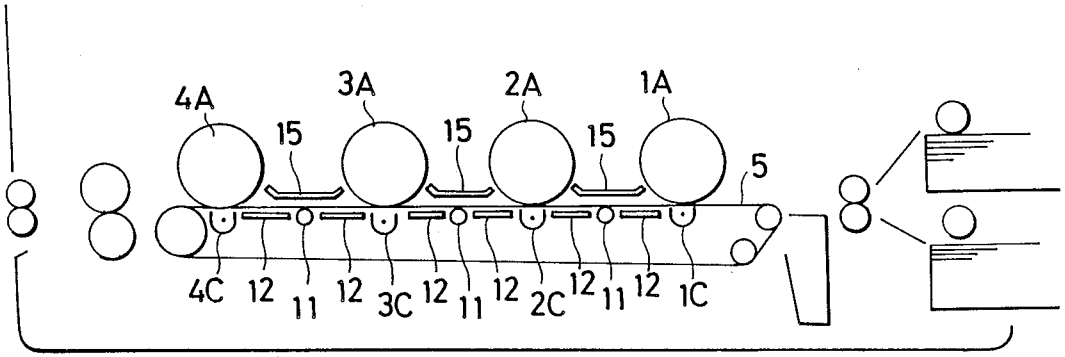
FIG. 7 is a constructional side view of a further embodiment of the present invention.

FIG. 7 illustrates a transfer unit comprising a transfer belt 5 and photoconductor drums 1A, 2A, 3A and 4A incorporated with the image forming apparatus of FIG. 6. As illustrated in the drawing, a plurality of electric field stabilizing plates 12 are disposed in the vicinity of the lower surface of the upper passage of the transfer belt 5 in the same manner as the structure of FIG. 1. In addition to these stabilizing plates 12, a plurality of electric field stabilizing plates 15 made from an electric conductive material such as a metal are disposed between every adjacent two photoconductor drums in the upper side of the upper passage of the transfer belt 5. Each of these electric field stabilizing plates 15 is arranged being separated from the transfer belt surface by a predetermined distance (usually 2 to 3 mm) so as not to come in contact with the record paper conveyed by the transfer belt. Each end of the upper stabilizing plate 15 is bent upward and outward. The distance between the upper stabilizing plate 15 and the transfer belt surface is determined within a range wherein the effect of the electric conductive member (upper stabilizing plate) 15 can be obtained. It is desirable that this distance is larger than the distance between the transfer belt and the lower electric conductive member 12 disposed in the lower side of the transfer belt 5.

The lower surface of the upper conductive member 15 facing to the transfer belt 5 is coated by a dielectric thin film (not shown) which is thin enough not to impede the function of the electric conductive member 15. The insulating thin film may be made for example from ethylene tetrafluoride resin which facilitates to clean the surface thereof by wiping off the toner attached thereon.

Also, each of the upper electric conductive members 15 serves as a cover for the transfer belt 5 so that the record paper carried on the transfer belt is prevented from being stained by developer agent or toner which falls off from the developing units 1B, 2B, 3B and 4B and cleaning units (not shown) disposed above the transfer belt 5.

Figure 8:
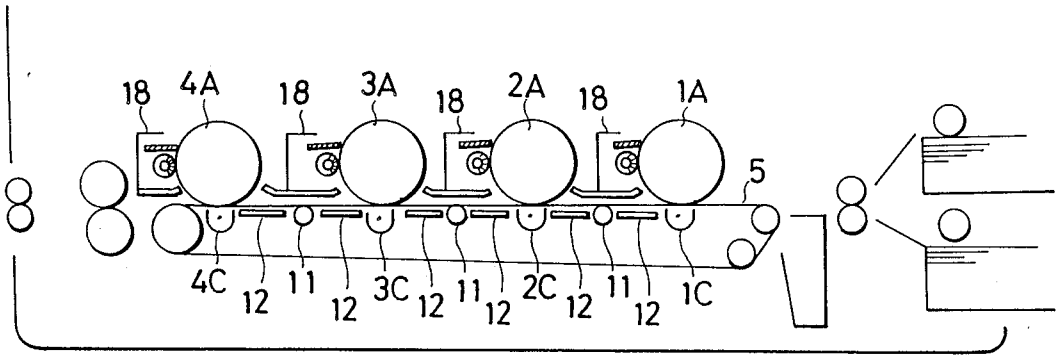
FIG. 8 is a consdtructional side view of a still further embodiment of the present invention.

Another embodiment of the present invention is described below with reference to FIG. 10. Conventionally, a cleaning unit is arranged for each photoconductor drum to remove toner or other dust particles remaining on the photoconductor drum surface after the image transferring operation. This embodiment of the present invention utilizes the cleaning unit as the electric conductive member disposed above the transfer belt as mentioned with regard to the previous embodiment of FIG. 7. The structure of this embodiment is illustrated in FIG. 8. Photoconductor drums 1A, 2A, 3A and 4A comprise a cleaning unit 18 which has a housing having a bottom portion which is made from an electric conductive material. The bottom portion of the cleaning unit housing is disposed along the transfer belt spacing a gap of about 2 to 3 mm therebetween so as to serve as an electric conductive member for stabilizing the electric field in accordence with the present invention.

By utilizing the cleaning unit as the electric field stabilezing conductive member of the present invention, it becomes unnecessary to provide special stabilizing conductive plates individually which makes it possible to simplify the structure of the recording apparatus and reduce the manufacturing cost thereof.

A still further embodiment of the present invention is described below with reference to FIG. 9. This embodiment comprises a structure of the present invention which is applied to an image recording apparatus comprising a single photoconductor drum and a single transfer drum on which a record paper is arranged wound in which a plurality of toner images are formed on the photoconductor drum surface and superposingly transferred to the record paper wound on the transfer drum one after another to form a multi-color toner image thereon.

Figure 9:
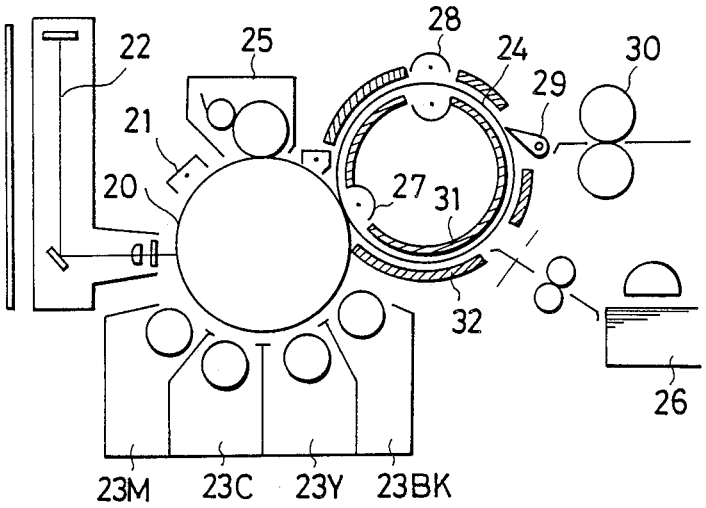
FIG. 9 is a constructional side view of an image recording apparatus comprising a single photoconductor and a single transfer drum, in which the structure of the present invention is arranged.

As illustrated in FIG. 9, around the photoconductor drum 20 are disposed an electrostatic charger 21, an image writing optical system 22, four different color developing devices 23M, 23C, 23Y and 23B, a transfer drum 24 and a cleaning unit 25 in this order along the rotational direction of the drum. The transfer drum 24 comprises a frame made from aluminium and a dielectric film such as a polyethylene terephthalate film arranged on the aluminium frame. The diameter of the transfer drum is the same as that of the photoconductor drum. The transfer drum is synchronized with the photoconductor drum and ratated at the same speed and in the same direction as the photoconductor drum at a circumferential portion where the drums come in contact together. A record paper is fed onto the transfer drum 24 from a paper feed unit 26. The leading end of the record paper is clamped on the transfer drum and the record paper is wound and held around the transfer drum surface. Four different color toner images are formed on the photoconductor drum surface one after another in order. The toner images are superposingly transferred to the record paper one above the other by the transfer charger 27 to form a multi-color toner image on the record paper. After that, the record paper on the transfer drum 24 is electrostatically eliminated by a static elimination charger 28 and separated from the transfer drum by a function of a doctor blade 29. The record paper is then guided to a fixing unit 30 where the toner image formed on the record paper is fixed to form a full color copy image thereon. Electric field stabilizing plates 31 and 32 in accordance with the present invention as mentioned before are arranged inside and outside the transfer drum 24, respectively, spacing a predetermined distance from the outer surface and inner surface thereof, respectively except for portions where electrostatic chargers are disposed and the inlet and the outlet for the record paper.

A still further embodiment of the present invention is described hereinafter. FIG. 10 illustrates an image transfer unit structure in which the present invention is applied to the image recording apparatus of FIG. 6 comprising a transfer belt 5 and photoconductor drums 1A, 2A, 3A and 4A. In this embodiment, rubber rollers 16 are arranged instead of the metallic back up rollers 11 of FIG. 7. The rubber roller 16 is illustrated in detail in FIG. 11. The rubber roller 16 comprises a metallic shaft **16*a* and a rubber body 16*b* of for example 3 mm thickness covering the shaft 16*a*. The shaft 16*a* is grounded to the earth and disposed in parallel with an axis of the photoconductor drum. The rubber roller 16 functions as a guide for guiding the transfer belt 5 in such a way that the rear surface of the transfer belt 5 is kept spaced from the electric field stabilizing plate 12 arranged behind the belt by a predetermined distance. The upper electric field stabilizing plate 15 disposed above the transfer belt 5 and the lower electric field stabilizing plate 12 disposed below the transfer belt 5** are both made from an electric conductive material such as metal and grounded to the earth.

Because of the upper and lower electric field stabilizing plates 15 and 12, it becomes possible to obtain a stable electric field and avoid disturbance of toner image, as in the case of the embodiments previously explained. In addition to the advantages mentioned above, the structure of FIG. 10 has a further advantage due to the rubber rollers 16 that the toner image is reliably conveyed without being scattered on the surface of the electric field stabilizing plates. This is because that the transfer belt 5 is conveyed maintaining a predetermined distance from the electric field stabilizing plate 12 without coming in contact with or very close to the stabilizing plate 12 due to the rubber rollers 16 which back up the transfer belt 5 and, besides, due to that the rollers are made from a dielectric material, the transfer belt 5 is completely insulated from the metallic roller shaft **16*a*, which prevents the elimination of the electrostatic charge on the lower surface of the transfer belt 5**.

Figure 10:
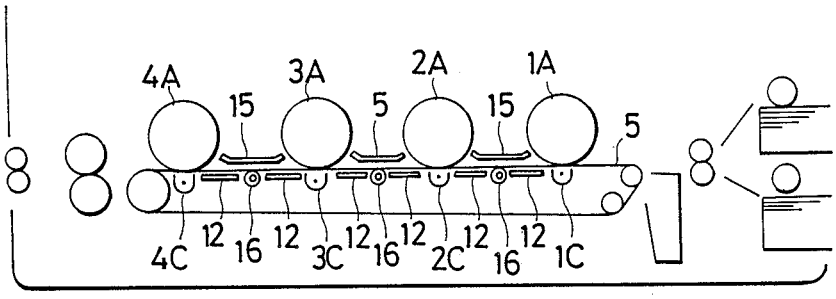
FIG. 10 is a constuctional side view of a still further embodiment of the present invention.
Figure 11:
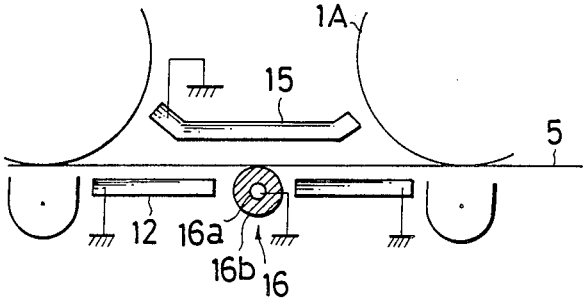
FIG. 11 is a partial enlarged sectional view of the structure of the embodiment of FIG. 10.
Figure 12:
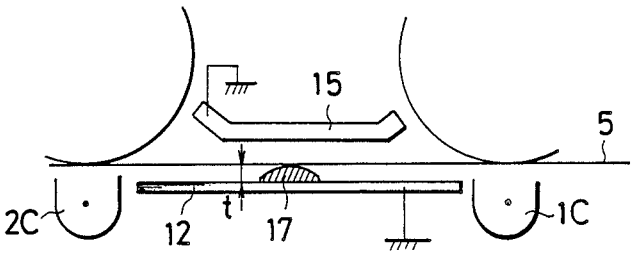
FIG. 12 is a partial enlarged sectional view of a still further embodiment of the present invention.

FIG. 12 illustrates another example of the dielectric back up member for guiding the transfer belt disposed instead of the rubber rollers 16 of FIGS. 10 and 11. The back up member of this image transfer structure of FIG. 12 comprises a partial cylindrical shaped dielectric guide member 17 having a semi-circular or partial circular sectional shape. The semi-cylindrical guide member 17 is mounted on a electric field stabilizing plate 12 which is made from an electric conductive material such as a metal and disposed spanning between the adjacent two transfer chargers 1C and 2C behind the transfer belt 5. The guide member 17 is disposed at a center portion on the stabilizing plate 12 and in parallel with the photoconductor drum axis so as to guide the transfer belt 5 to move with a predetermined distance maintained from the stabilizing plate 12. The upper electric field stabilizing plate 15 and the lower electric field stabilizing plate 12 are grounded to the earth.

The structure of FIG. 12 functions in the same way as the structure of FIG. 11. The guide member 17 of FIG. 12 is easy to produce and various materious can be utilized in comparison to the rubber roller of FIG. 11.

Table 1 represents an experimental result with respect to the effect of prevention of scattering the toner in accordance with the present invention in relation to the height of the guide member 17 which defines the distance between the transfer belt 5 and the electric field stabilizing plate 12 with regard to different materials for the guide member 17.

TABLE 1

| MATERIAL (VOL. Resist.) DISTANCE t(cm) | Phenol Resin ($10^{11}$ Ωcm) | Nylon Resin ($10^{12}$ Ωcm) |
|---|---|---|
| 1.0 | X | X |
| 1.5 | X | X |
| 2.0 | X | X |
| 2.5 | X | X |
| **MATERIAL (Vol. Resist.) DISTANCE t(cm)** | **Polyacetal ($10^{14}$ Ωcm)** | **Polybutylene Terephalate ($10^{16}$ Ωcm)** |
| 1.0 | X | Δ |
| 1.5 | Δ | O |
| 2.0 | O | O |
| 2.5 | O | O |

X: toner scattered
Δ: toner slightly scattered
O: non-scattered

It can be seen from the table that toner is prevented from scattering when the distance between the transfer belt and the electric field stabilizing plate is equal to or more than 2.0 mm and the volume resistance of the insulation material of the guide member is more than $10^{13}$Ωcm.

In the embodiments mentioned abeve, the present invention is applied to the image transfer unit in which a plurality of toner images are superposingly transferred to a record paper carried by a transfer belt. However, application of the present invention is not limited to the structure mentioned above. The present invention can be applied to an image transfer unit structure in which the transfer belt is used as a transfer medium in such a way that a plurality of toner images are directly transferred to the transfer belt so that the toner images superpose one above the other to form a multi-color toner image on the belt and in which the multi-color toner image formed on the transfer belt is transferred to the record paper at a time.

Figure 13:
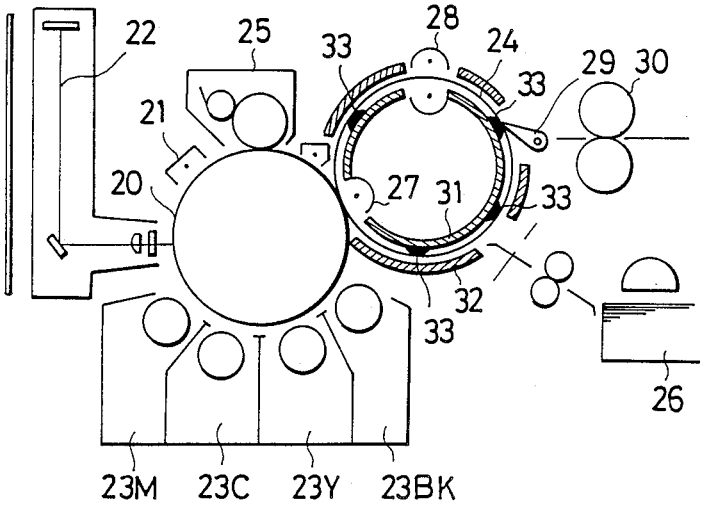
FIG. 13 is a constructional side view of another example of an image recording apparatus comprising a single photoconductor and a single transfer drum, in which the structure of the present invention is arranged.

FIG. 13 illustrates a still further embodiment of the present invention. This embodiment comprises an electric field stabilizing structure in which the guide member 33 which corresponds to the guide member 17 of FIG. 12 is disposed on an electric field stabilizing plate 31 disposed inside the transfer drum 24 in addition to the structure of FIG. 9. With this structure, the transfer belt is conveyed with a predetermined distance maintained from the electric field stabilizing plate 31, as fully described with reference to FIG. 12.

As mentioned above, in accordance with the embodiment of the present invention, it becomes possible to stabilize the electric field in the conveying area of the toner image so that a high grade and clear toner image can be ontained. Also, in accordance with the further embodiment of the present invention, when the fluidity aiding agent is added to the developer to avoid partial transfer miss of the toner image, it becomes possible to avoid scattering of the toner and obviate the problems of degradation of clearness of the toner image and rubbing of the image.

Many widely different embodiments of the present invention may be constructed without departing from the sprit and scope of the present invention. It should be understood that the present invention is not limited to the specific embodiments described in the specification, except as defined in the appended claims.

We claim:

1. An image transfer unit for an image recording apparatus, comprising:
   - a plurality of photoconductor units on which a toner image is formed;
   - a dielectric transfer belt which circulates along and in contact with said plurality of photoconductor units on an outer surface of said transfer belt for conveying record papers;
   - at least one transfer charger for applying an electric field and for transferring the toner image from each of said plurality of photoconductor units to the record papers conveyed on said transfer belt in such a manner that a plurality of toner images are superposed on each other one by one; and
   - a lower electric conductive member for stabilizing the electric field of the at least one transfer charger, said lower electric conductive member being disposed at and spaced from an inner surface side of said transfer belt in the vicinity of said plurality of photoconductor units at a predetermined distance from an inner surface of said transfer belt, said lower conductive member being grounded and in the form of a flat plate.

2. An image transfer unit according to claim 1, further comprising an upper electric conductive member disposed at and spaced from an outer surface side of said transfer belt in the vicinity of said plurality of photoconductor units at a predetermined distance from said outer surface of said transfer belt and being grounded.

3. An image transfer unit according to claim 2, wherein said upper electric conductive member is coated with an insulating layer on a lower surface thereof.

4. An image transfer unit according to any one of claims 1 to 3, wherein said transfer charger comprises a corona discharge wire disposed within a shield housing arranged along a lateral direction of said plurality of photoconductor units, and wherein a distance between an end of said shield housing of said transfer charger and a portion of said inner surface of said transfer belt directly above said end is larger than a distance between said portion of said inner surface of said transfer belt and an end of said lower electric conductive member.

5. An image transfer unit according to any one of claims 1 to 3, wherein said transfer charger comprises a corona discharge wire disposed within a shield housing arranged along a lateral direction of said plurality of photoconductor units, and wherein an end of said shield housing is connected to an end of said lower electric conductive member to form a continuous conductive shield structure at said inner surface side of said transfer belt.

6. An image transfer unit for an image recording apparatus, comprising:
   - a plurality of photoconductor units on which a toner is formed;
   - a dielectric transfer belt which circulates along and in contact with said plurality of photoconductor units on an outer surface of said transfer belt for conveying record papers;
   - at least one transfer charger for applying an electric field and for transferring said toner image from each of said plurality of photoconductor units directly to said transfer belt in such a manner that a plurality of toner images are superposed on each other one by one; and
   - a lower electric conductive member for stabilizing the electric field of said at least one transfer charger, said lower electric conductive member being disposed at and spaced from an inner surface side of said transfer belt in the vicinity of said plurality of photoconductor units at a predetermined distance from an inner surface of said transfer belt, said lower conductive member being grounded and in the form of a flat plate.

7. An image transfer unit according to claim 6, further comprising an upper electric conductive member disposed at and spaced from an outer surface side of said transfer belt in the vicinity of the plurality of photoconductor units at a predetermined distance from said outer surface of said transfer belt, said upper electric conductive member being grounded.

8. An image transfer unit according to claim 7, wherein said upper electric conductive member is coated with an insulating layer on a lower surface thereof.

9. An image transfer unit according to claim 7, wherein said upper electric conductive member is constituted by a housing frame of a cleaning unit for said plurality of photoconductor units disposed above said transfer belt.

10. An image transfer unit according to claim 6, wherein a dielectric guide means is disposed over and in contact with said transfer belt along a lateral direction thereof to guide said transfer belt in such a manner that said transfer belt is conveyed maintaining a predetermined distance from said lower electric conductive member.

11. An image transfer unit according to claim 10, wherein said guide means comprises a plurality of rubber rollers.

12. An image transfer unit according to claim 10, wherein said at least one transfer charges is more than one and wherein said lower electric conductive member is disposed between adjacent transfer chargers disposed at said inner surface side of said transfer belt and wherein said guide means comprises a partial cylindrical member mounted on said lower electric conductive member at a center portion thereof at said inner surface side of said transfer belt.

* * * * *

UNITED STATES PATENT AND TRADEMARK OFFICE

CERTIFICATE OF CORRECTION

PATENT NO. : 4,984,024

DATED : January 8, 1991

INVENTOR(S) : Hiroyuki Ohkaji et al.

It is certified that error appears in the above-identified patent and that said Letters Patent is hereby corrected as shown below:

Title page:

In the Foreign Application Priority Data, the fourth priority information is incorrect, should be, --Mar. 15, 1989 [JP] JAPAN .....1-60612--.

Signed and Sealed this

Twenty-ninth Day of September, 1992

*Attest:*

DOUGLAS B. COMER

*Attesting Officer*

*Acting Commissioner of Patents and Trademarks*